US007784713B2

(12) United States Patent
Kondo

(10) Patent No.: US 7,784,713 B2
(45) Date of Patent: Aug. 31, 2010

(54) FUEL INJECTION VALVE

(75) Inventor: Jun Kondo, Nagoya (JP)

(73) Assignee: Denso Corporation, Kariya (JP)

( * ) Notice: Subject to any disclaimer, the term of this patent is extended or adjusted under 35 U.S.C. 154(b) by 228 days.

(21) Appl. No.: 12/174,888

(22) Filed: Jul. 17, 2008

(65) Prior Publication Data

US 2009/0065613 A1 Mar. 12, 2009

(30) Foreign Application Priority Data

Sep. 7, 2007 (JP) ..... 2007-232379

(51) Int. Cl.
*B05B 1/08* (2006.01)
*B05B 1/30* (2006.01)

(52) U.S. Cl. ..... 239/102.2; 239/584

(58) Field of Classification Search ..... 239/102.2, 239/88, 89, 91, 95, 533.2, 533.9, 584, 585.1, 239/585.3, 585.4, 585.5; 251/129.15, 129.21, 251/127

See application file for complete search history.

(56) References Cited

U.S. PATENT DOCUMENTS 5,452,858 A * 9/1995 Tsuzuki et al. ..... 239/533.8
5,979,803 A * 11/1999 Peters et al. ..... 239/533.4
6,420,817 B1 7/2002 Ricci-Ottati et al.
6,425,368 B1 * 7/2002 Lambert ..... 123/300
6,647,966 B2 * 11/2003 Tian et al. ..... 123/467
7,455,244 B2 * 11/2008 Boecking ..... 239/102.2
2007/0152084 A1 7/2007 Boecking

FOREIGN PATENT DOCUMENTS

JP 10-288116 10/1998

* cited by examiner

*Primary Examiner*—Davis Hwu
(74) *Attorney, Agent, or Firm*—Nixon & Vanderhye PC

(57) ABSTRACT

A fuel injection valve includes a body having a high pressure fuel passage and a nozzle hole, which is connected to the passage, a nozzle needle opening/closing the hole and having a needle piston part, a piezo stack extended when the stack is charged and contracted when the stack discharges electric charge, a cylinder, in which the needle piston part is slidably inserted and which is driven by the stack, a fixed piston having a fixed piston part that is slidably inserted in the cylinder and that has a larger diameter than the needle piston part, an oil-tight chamber between the needle piston part and the fixed piston part in the cylinder, and a nozzle spring urging the needle in a valve closing direction. The cylinder is displaced due to extension/contraction of the stack, so that volume of the chamber increases/decreases and the needle opens/closes the hole.

6 Claims, 7 Drawing Sheets

FUEL INJECTION VALVE

CROSS REFERENCE TO RELATED APPLICATION

This application is based on and incorporates herein by reference Japanese Patent Application No. 2007-232379 filed on Sep. 7, 2007.

BACKGROUND OF THE INVENTION

1. Field of the Invention

The present invention relates to a fuel injection valve for injecting fuel into an internal combustion engine.

2. Description of Related Art

In a fuel injection valve shown in U.S. Pat. No. 6,420,817B1, a valve closing operation is performed on a nozzle needle (i.e., the nozzle needle closes a nozzle hole) when a piezo stack is charged with electric charge to have a high voltage, and a valve opening operation is performed on the nozzle needle when the electric charge is discharged and thereby the piezo stack has a low voltage. In such a case, while an internal combustion engine is in operation, a period during which the piezo stack is at a high voltage is longer than a period during which the piezo stack is at a low voltage. Thus, the above fuel injection valve is not desirable in respect of reliability (e.g., durability) of the piezo stack.

Accordingly, a fuel injection valve, which is configured such that the valve opening operation is performed on the nozzle needle while the piezo stack is at a high voltage and the valve closing operation is performed on the nozzle needle while the piezo stack is at a low voltage, is proposed in, for example, JP-T-2007-500304 (corresponding to US2007/0152084A1).

As shown in FIG. 9, in the fuel injection valve of JP-T-2007-500304, when a piezo stack 900 has a high voltage and is thereby extended, a first transfer piston 910 is driven, and accordingly a pressure of fuel in an oil-tight chamber 920 rises. A pressure of fuel in the oil-tight chamber 920 is applied to an annular surface 941 of a second transfer piston 940 formed integrally with a nozzle needle 930, and as a result, the nozzle needle 930 opens a nozzle hole.

However, in the fuel injection valve of JP-T-2007-500304, there are three sliding portion clearances between a high pressure fuel passages 950, through which high pressure fuel flows, and the oil-tight chambers 920. Consequently, when the fuel injection valve is in the valve opening operation, an amount of fuel, which leaks out of the oil-tight chamber 920 to the high pressure fuel passage 950 through the above clearances, increases. In addition, the three sliding portion clearances are a clearance between the first transfer piston 910 and the second transfer piston 940, a clearance between the first transfer piston 910 and a sleeve 960, and a clearance between the nozzle needle 930 and a guide part 970.

When the amount of fuel leaking out of the oil-tight chamber 920 to the high pressure fuel passage 950 increases, drive transmission efficiency is decreased. In the present specification, the decrease in the drive transmission efficiency means a decrease in an actual displacement enlargement factor (=a lift amount of a nozzle needle/a stretch amount of a piezo actuator).

When the amount of fuel leaking out of the oil-tight chamber 920 to the high pressure fuel passage 950 increases, the nozzle lift decreases and thus a spray state deteriorates in a late phase of the injection due to a pressure drop of the oil-tight chamber 920, in the case of a long fuel injection period.

Furthermore, it is difficult to make large an area of the annular surface 941 of the second transfer piston 940. Therefore, a differential pressure between the oil-tight chamber 920 and the high pressure fuel passage 950 needs to be made larger, in order that the nozzle needle 930 opens the nozzle hole.

As the differential pressure between the oil-tight chamber 920 and the high pressure fuel passage 950 becomes larger, the amount of fuel leaking out of the oil-tight chamber 920 to the high pressure fuel passage 950 increases. As a result, problems such as the decrease in the drive transmission efficiency and the deterioration of the spray state become more noticeable.

Additionally, in order to make large the differential pressure between the oil-tight chamber 920 and the high pressure fuel passage 950, an extension amount of the piezo stack 900 needs to be increased for the fuel pressure of the oil-tight chamber 920 to be high enough. For this reason, charging energy supplied to the piezo stack 900 increases.

SUMMARY OF THE INVENTION

The present invention addresses the above disadvantages. Thus, it is an objective of the present invention to improve drive transmission efficiency while a fuel injection valve is in valve opening operation and to reduce charging energy supplied to a piezo stack. In the above fuel injection valve, a nozzle needle is operated to open a nozzle hole when a piezo stack has a high voltage.

To achieve the objective of the present invention, there is provided a fuel injection valve including a body, a nozzle needle, a piezo stack, a cylinder, a fixed piston, an oil-tight chamber, and a nozzle spring. The body has a high pressure fuel passage, through which high-pressure fuel flows, and a nozzle hole, which is connected to the high pressure fuel passage. The nozzle needle is disposed to open and close the nozzle hole and has a needle piston part. The piezo stack is configured to be extended when the piezo stack is charged with electric charge and is configured to be contracted when the piezo stack discharges the electric charge. The needle piston part of the nozzle needle is slidably inserted in the cylinder, and the cylinder is driven by the piezo stack. The fixed piston is fixed to the body and has a fixed piston part, which is slidably inserted in the cylinder. A diameter of the fixed piston part is larger than a diameter of the needle piston part. The oil-tight chamber is defined by the needle piston part and the fixed piston part and is located between the needle piston part and the fixed piston part in the cylinder. The nozzle spring is disposed to urge the nozzle needle in a direction in which the nozzle needle closes the nozzle hole. The cylinder is displaced as a result of the extension of the piezo stack, so that volume of the oil-tight chamber increases and thereby the nozzle needle opens the nozzle hole. The cylinder is displaced as a result of the contraction of the piezo stack, so that the volume of the oil-tight chamber decreases and thereby the nozzle needle closes the nozzle hole.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

A first embodiment of the invention is described below.

A fuel injection valve is attached to a cylinder head of an internal combustion engine (more specifically a diesel engine: not shown), and injects high pressure fuel stored in a pressure accumulator (not shown) into a cylinder of the engine.

Figure 1:
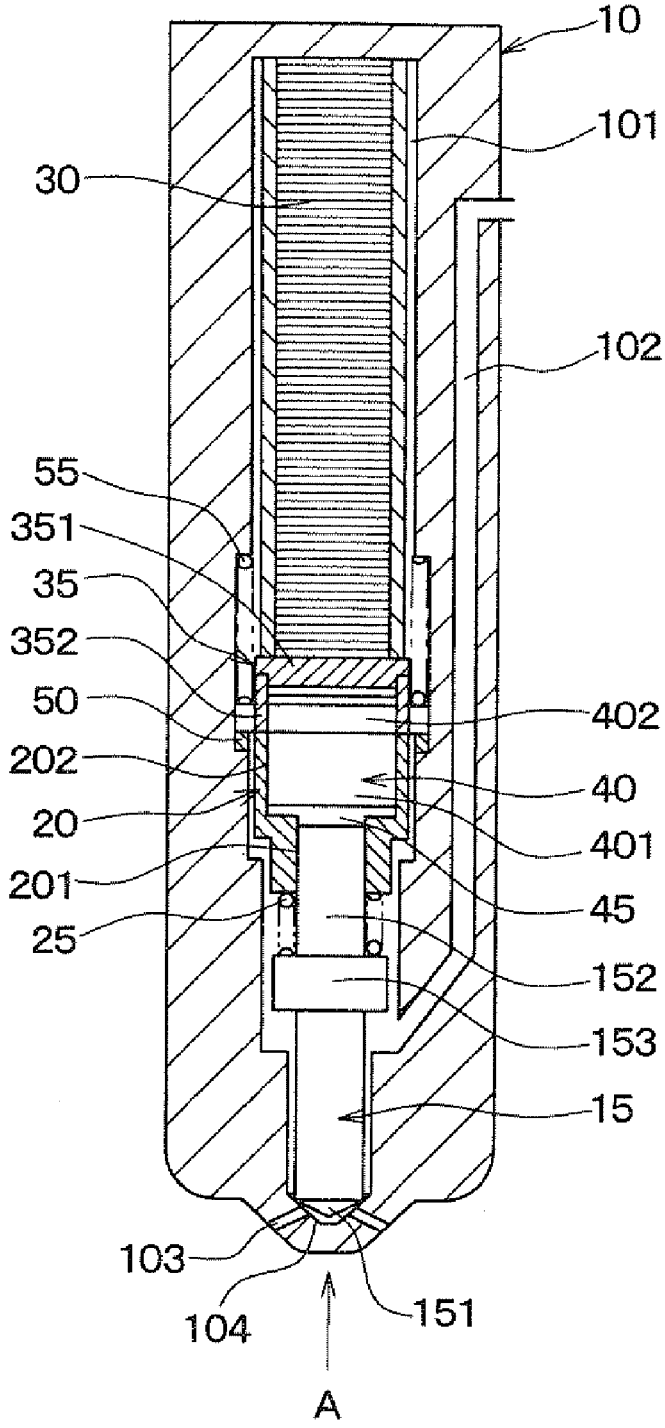
FIG. 1 is a longitudinal sectional view illustrating a configuration of a fuel injection valve according to a first embodiment of the invention.

As shown in FIG. 1, a receiving space 101 having a generally cylindrical shape, a high pressure fuel passage 102, through which high pressure fuel supplied by the pressure accumulator flows, and a nozzle hole 103, through which high pressure fuel is injected into the cylinder of the engine, are formed in a body 10 of the fuel injection valve having a generally cylindrical shape. The receiving space 101 extends along a axial direction (hereinafter referred to as a body axial direction) of the body 10, in a central portion of the body 10 in a radial direction (hereinafter referred to as a body radial direction) of the body 10. The high pressure fuel passage 102 is located outward of the receiving space 101 in the body radial direction, and extends along the body axial direction. The nozzle hole 103 is located one end of the body 10 in the body axial direction. The high pressure fuel passage 102 is connected to the receiving space 101 near a position, where a nozzle needle 15 (to be described in greater detail hereinafter) is disposed, and communicates with the nozzle hole 103 via the receiving space 101. In addition, in the present specification, the receiving space 101 and the high pressure fuel passage 102 are collectively referred to as a high pressure fuel system 101, 102.

The nozzle needle 15, which opens and closes the nozzle hole 103, is slidably held by the body 10 in one end side (nozzle hole 103-side) of the receiving space 101 in the body radial direction. More specifically, a tapered valve seat 104 is formed on the body 10 on an upstream side of the nozzle hole 103, and the nozzle hole 103 is closed and opened when a seat part 151 formed on the nozzle needle 15 approaches or separates from the valve seat 104.

A cylindrical needle piston part 152 is formed on the nozzle needle 15 on an opposite side of the nozzle needle 15 from the seat part 151. The needle piston part 152 is slidably inserted in a cylinder 20 (to be described in greater detail hereinafter).

The nozzle needle 15 has a flanged portion 153 at its intermediate part in an axial direction of the needle 15, and a nozzle spring 25 is arranged between the flanged portion 153 and the cylinder 20. A compression coil spring is used for the nozzle spring 25, and the nozzle needle 15 is urged in a valve closing direction by the nozzle spring 25.

A piezo stack 30, which includes many stacked piezoelectric elements and is expanded and contracted by the charge and discharge of electric charge, is received in the other end side (opposite side of the nozzle hole 103) of the receiving space 101 in the body axial direction. A push plate 35 (to be described in greater detail hereinafter) is arranged between the piezo stack 30 and the cylinder 20, and the cylinder 20 is driven by the piezo stack 30 through the push plate 35 when the piezo stack 30 is extended.

The cylinder 20 has a cylindrical shape with a step having a step portion on its inner circumferential surface. A columnar first cylinder hole 201 is formed on one side of the step portion, and a columnar second cylinder hole 202 having a larger diameter than the first cylinder hole 201 is formed on the other side of the step portion. The first cylinder hole 201 and the second cylinder hole 202 are arranged in series in the body axial direction, and more specifically, the first cylinder hole 201 is located further on the one end side in the body axial direction than the second cylinder hole 202.

The needle piston part 152 is slidably inserted in the first cylinder hole 201, and a columnar fixed piston part 401 formed in a fixed piston 40 is slidably inserted in the second cylinder hole 202. The fixed piston part 401 has a larger diameter than the needle piston part 152. Accordingly, volume of the oil-tight chamber 45 when the cylinder 20 is displaced due to the extension of the piezo stack 30 is increased.

In the cylinder 20, a oil-tight chamber 45 is defined by the needle piston part 152 and the fixed piston parts 401 between the needle piston part 152 and the fixed piston parts 401. The oil-tight chamber 45 communicates with the receiving space 101 through a clearance between the first cylinder hole 201 and the needle piston part 152 and a clearance between the second cylinder hole 202 and the fixed piston part 401.

Figure 2:
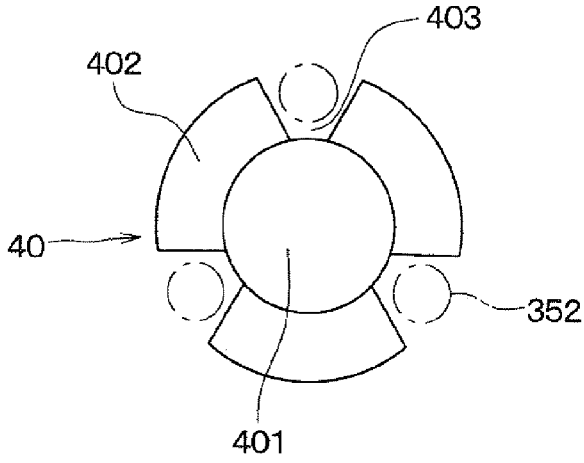
FIG. 2 is a schematic view illustrating a fixed piston in FIG. 1 viewed from a direction A.

As shown in FIG. 2, the fixed piston 40 has a flanged portion 402, which projects radially outward from the fixed piston part 401. The flanged portion 402 is divided into three pieces along its circumferential direction, and a notch section 403 is formed between two adjacent flanged portions 402. As shown in FIG. 1, the flanged portion 402 is held between a cylindrical spacer 50 and a fixed spring 55 and thereby the fixed piston 40 is fixed to the body 10.

Figure 3A:
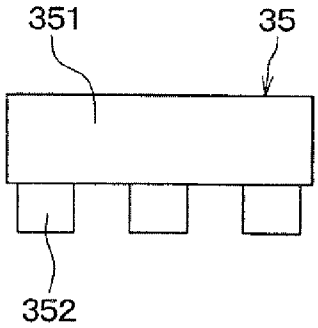
FIG. 3A is a front view illustrating a push plate in FIG. 1.
Figure 3B:
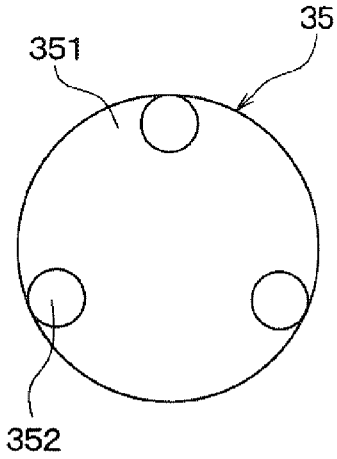
FIG. 3B is a bottom view illustrating the push plate.

As shown in FIGS. 3A, 3B, the push plate 35 has a columnar disk part 351 and a columnar leg 352, which projects in an axial direction of the disk part 351 from one end surface of the disk part 351. There are three legs 352 along a circumferential direction of the disk part 351, and each of the three legs 352 is inserted in the corresponding notch section 403 of the fixed piston 40 (see FIG. 2). As shown in FIG. 1, the disk part 351 of the push plate 35 in contact with the piezo stack 30, and the leg 352 of the push plate 35 is in contact with the cylinder 20.

Figure 4A:
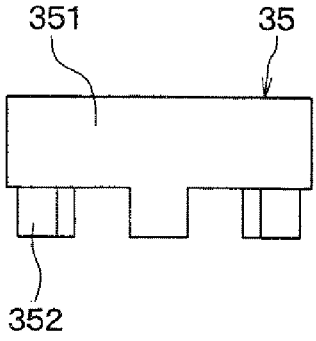
FIG. 4A is a front view illustrating a modified example of the push plate.
Figure 4B:
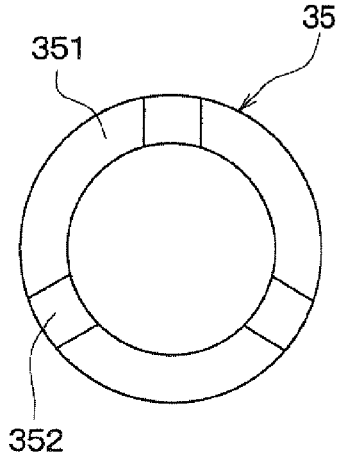
FIG. 4B is a bottom view illustrating the modified example of the push plate.

Additionally, a push plate 35 shown in FIGS. 4A, 4B may be used for the push plate 35. As shown in FIGS. 4A, 4B, a leg 352 of the push plate 35 may be formed in a generally prismatic column.

Workings of the fuel injection valve are explained below. FIG. 1 shows a valve closing state of the fuel injection valve. In the above state, high pressure fuel flows into the oil-tight chamber 45 from the receiving space 101 through the clearance between the first cylinder hole 201 and the needle piston part 152 and the clearance between the second cylinder hole 202 and the fixed piston part 401, and as a result, a pressure of the oil-tight chamber 45 is equal to a pressure of the high pressure fuel system 101, 102. The nozzle needle 15 is urged in the valve closing direction by a pressure of the oil-tight chamber 45 applied to the needle piston part 152, and is urged in the valve closing direction by the nozzle spring 25 to be in the valve closing state.

When a charging current is supplied to the piezo stack 30 (i.e., the piezo stack 30 is charged with an electric charge) and thereby a piezo voltage increases, the piezo stack 30 is extended. Accordingly, the cylinder 20 is driven from the other end side toward the one end side in the body axial direction via the push plate 35 and thereby the volume of the oil-tight chamber 45 is expanded. Consequently, the pressure of the oil-tight chamber 45 decreases and thus force, which urges the nozzle needle 15 in the valve closing direction, decreases. Therefore, the nozzle needle 15 is displaced in a valve opening direction, and the seat part 151 disengages from the valve seat 104 so as to open the nozzle hole 103. As a result, fuel is injected into the cylinder of the engine through the nozzle hole 103.

After that, when the electric charge is discharged from the piezo stack 30 and thereby the piezo voltage falls, the piezo stack 30 is contracted. Accordingly, the cylinder 20 is returned toward the piezo stack 30 by the nozzle spring 25, and thereby the volume of the oil-tight chamber 45 is reduced. Consequently, the pressure of the oil-tight chamber 45 rises and thus the force, which urges the nozzle needle 15 in the valve closing direction, increases. Therefore, the nozzle needle 15 is displaced in the valve closing direction, and the seat part 151 engages the valve seat 104 so as to close the nozzle hole 103. As a result, the fuel injection is ended.

In the fuel injection valve of the first embodiment, a sliding portion clearance between the oil-tight chamber 45 and the receiving space 101 includes two areas, that is, the clearance between the first cylinder hole 201 and the needle piston part 152 and the clearance between the second cylinder hole 202 and the fixed piston part 401. Thus, an amount of fuel, which leaks into the oil-tight chamber 45 from the receiving space 101 through the above clearances when the fuel injection valve is in valve opening operation, decreases, so that drive transmission efficiency is improved.

Moreover, as will be described below, according to the fuel injection valve of the first embodiment, a differential pressure between the oil-tight chamber 45 and the high pressure fuel system 101, 102 is made small.

In the fuel injection valve shown in JP-T-2007-500304, it is assumed that an outer diameter (i.e., outer diameter of the oil-tight chamber 920) of the first transfer piston 910 is A, an outer diameter (i.e., outer diameter of the annular surface 941) of the second transfer piston 940 is B, an outer diameter (i.e., inner diameter of the annular surface 941) of a portion of the nozzle needle 930 held by the guide part 970 is C, and a displacement enlargement factor is K1. In addition, K1 is equal to $(A^2-B^2)/(B^2-C^2)$.

In the fuel injection valve of the first embodiment, it is assumed that an outer diameter of the fixed piston part 401 is D, an outer diameter of the needle piston part 152 is E, and a displacement enlargement factor is K2. In addition, K2 is equal to $(D^2-E^2)/E^2$.

Given that A is D, K1 is K2, and C is larger than 0 (zero), an expression $B^2-C^2<E^2$ is satisfied. Therefore, a cross-sectional area of the needle piston part 152 of the fuel injection valve of the first embodiment is larger than an area of the annular surface 941 of the fuel injection valve of JP-T-2007-500304.

Accordingly, in the fuel injection valve of the first embodiment, the differential pressure between the oil-tight chamber 45 and the high pressure fuel system 101, 102 is made smaller than in the fuel injection valve of JP-T-2007-500304. As a result, an amount of fuel, which leaks from the high pressure fuel system 101, 102 into the oil-tight chamber 45 when the fuel injection valve is in valve opening operation, is made smaller and thereby the drive transmission efficiency is improved. Furthermore, corresponding to reduction in the leaking amount, an extension amount of the piezo stack 30 can be set at a small value. Consequently, charging energy supplied to the piezo stack 30 can be reduced.

In the first embodiment, the high pressure fuel passage 102 is connected to the receiving space 101 near the position at which the nozzle needle 15 is arranged, in other words, the high pressure fuel passage 102 extends close to the nozzle hole 103. Accordingly, a pressure drop is small and a good fuel spray is achieved.

Second Embodiment

A second embodiment of the invention is explained below. The same numerals as those used in the first embodiment are used for components, which are the same as or equivalent to the components of the first embodiment, and their descriptions are omitted.

Figure 5:
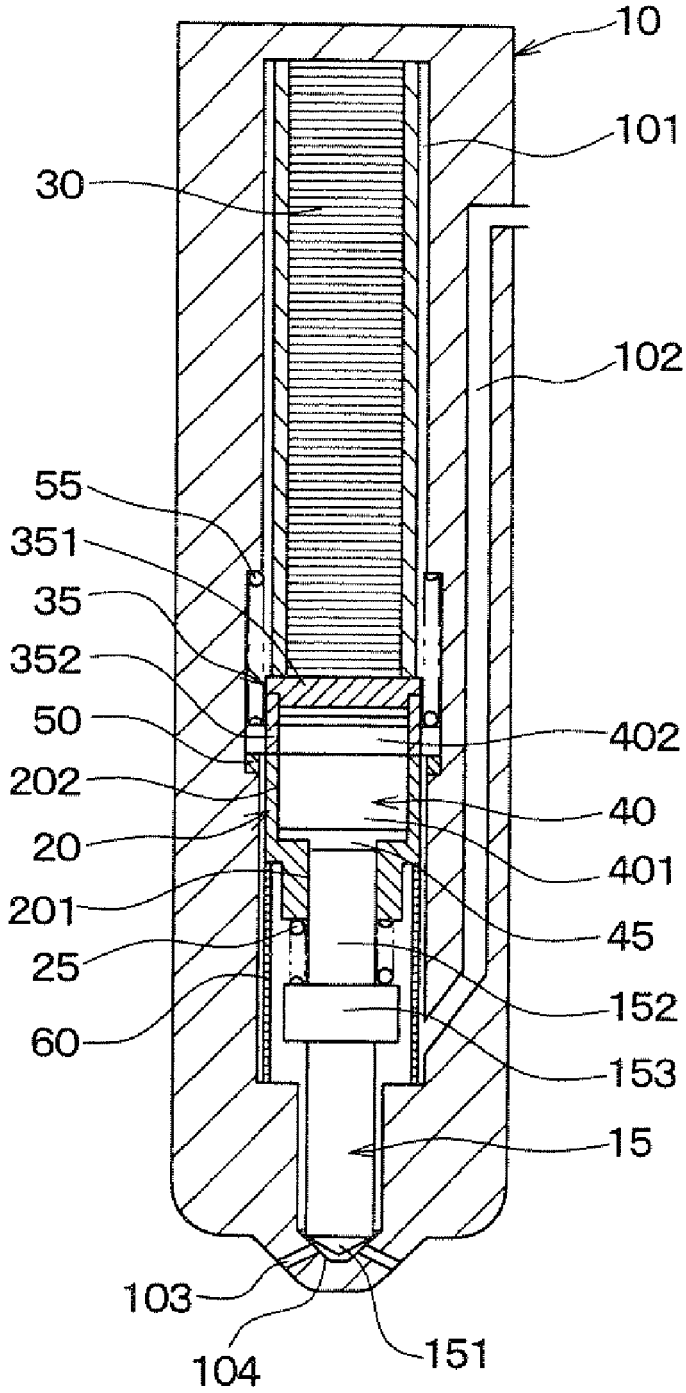
FIG. 5 is a longitudinal sectional view illustrating a configuration of a fuel injection valve according to a second embodiment of the invention.

As shown in FIG. 5, in a fuel injection valve of the second embodiment, a piezo spring 60 is arranged between a body 10 and a cylinder 20. The piezo spring 60 urges the cylinder 20 in a direction in which volume of an oil-tight chamber 45 reduces.

Accordingly, when the electric charge is discharged from a piezo stack 30 and thereby the piezo voltage falls, the cylinder 20 is returned toward the piezo stack 30 by a nozzle spring 25 and the piezo spring 60. Therefore, a response of the fuel injection valve in closing a nozzle hole 103 is improved.

Also, because a load of the piezo spring 60 is not applied to a nozzle needle 15, the fuel injection valve has a high degree of flexibility in setting a spring constant of the piezo spring 60. Therefore, by setting the spring constant of the piezo spring 60 at a large value, the response of the fuel injection valve in closing the nozzle hole 103 is further improved.

Figure 6A:
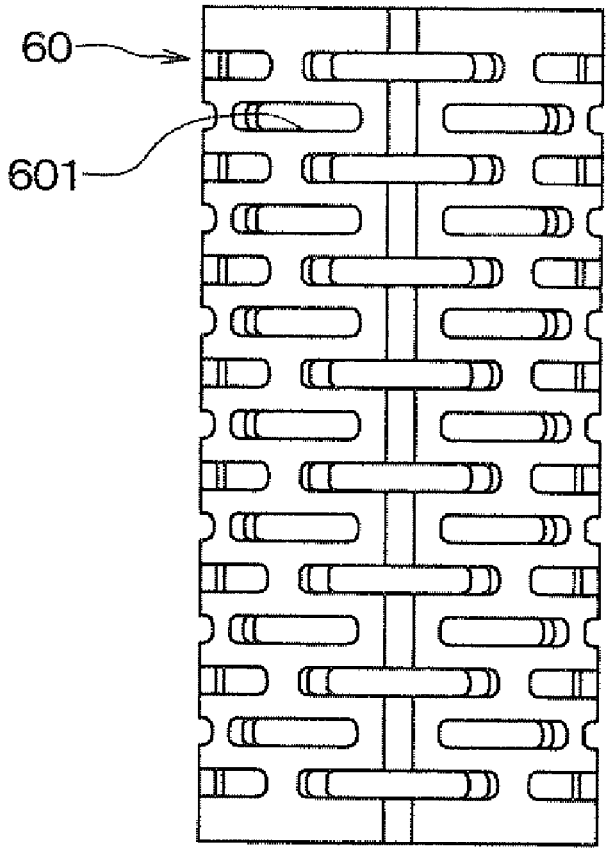
FIG. 6A is a front view illustrating a piezo spring in FIG. 5.
Figure 6B:
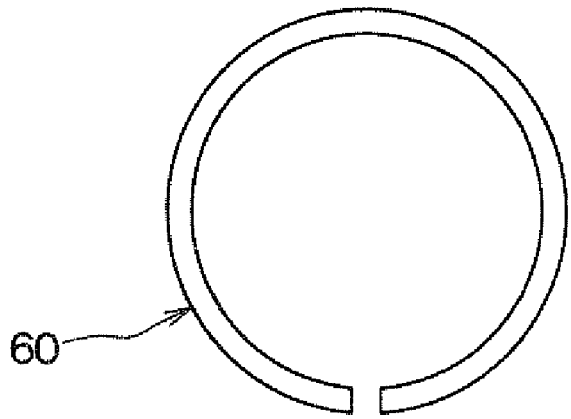
FIG. 6B is a plan view illustrating the piezo spring.

As shown in FIGS. 6A, 6B, the piezo spring 60 employs a slit spring, which is formed as a result of forming a metal plate material having many holes 601 in a staggered manner to have a cylindrical shape. Using the slit spring, a spring having a large spring constant is easily obtained.

Third Embodiment

A third embodiment of the invention is explained below. In the third embodiment, a position where a high pressure fuel passage 102 is connected to a receiving space 101 is different from the second embodiment. The same numerals as those used in the second embodiment are used for components, which are the same as or equivalent to the components of the second embodiment, and their descriptions are omitted.

Figure 7:
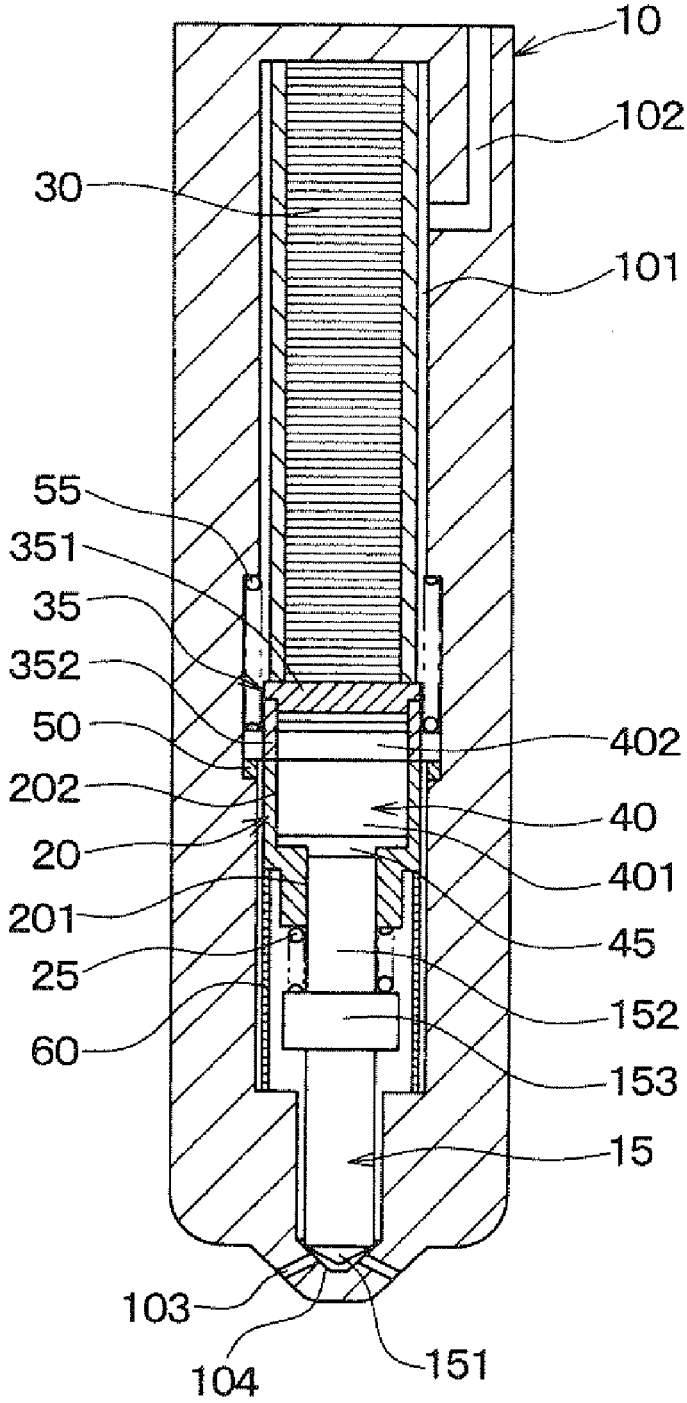
FIG. 7 is a longitudinal sectional view illustrating a configuration of a fuel injection valve according to a third embodiment of the invention.

As shown in FIG. 7, in a fuel injection valve of the third embodiment, the high pressure fuel passage 102 is connected to the receiving space 101 near the other end side of a receiving space 101 in a body axial direction. Accordingly, the high pressure fuel passage 102 does not need to be located near a side surface of the body 10. Thus, reliability (internal-pressure strength) of the fuel injection valve is improved, and a diameter of the receiving space 101 is made large. By making larger the diameter of the receiving space 101, the fuel injection valve has a higher degree of flexibility in designing components, which are received in the receiving space 101.

Fourth Embodiment

A fourth embodiment of the invention is described below. In the fourth embodiment, a position where a high pressure fuel passage 102 is connected to a receiving space 101 is different from the second embodiment. The same numerals as those used in the second embodiment are used for components, which are the same as or equivalent to the components of the second embodiment, and their descriptions are omitted.

Figure 8:
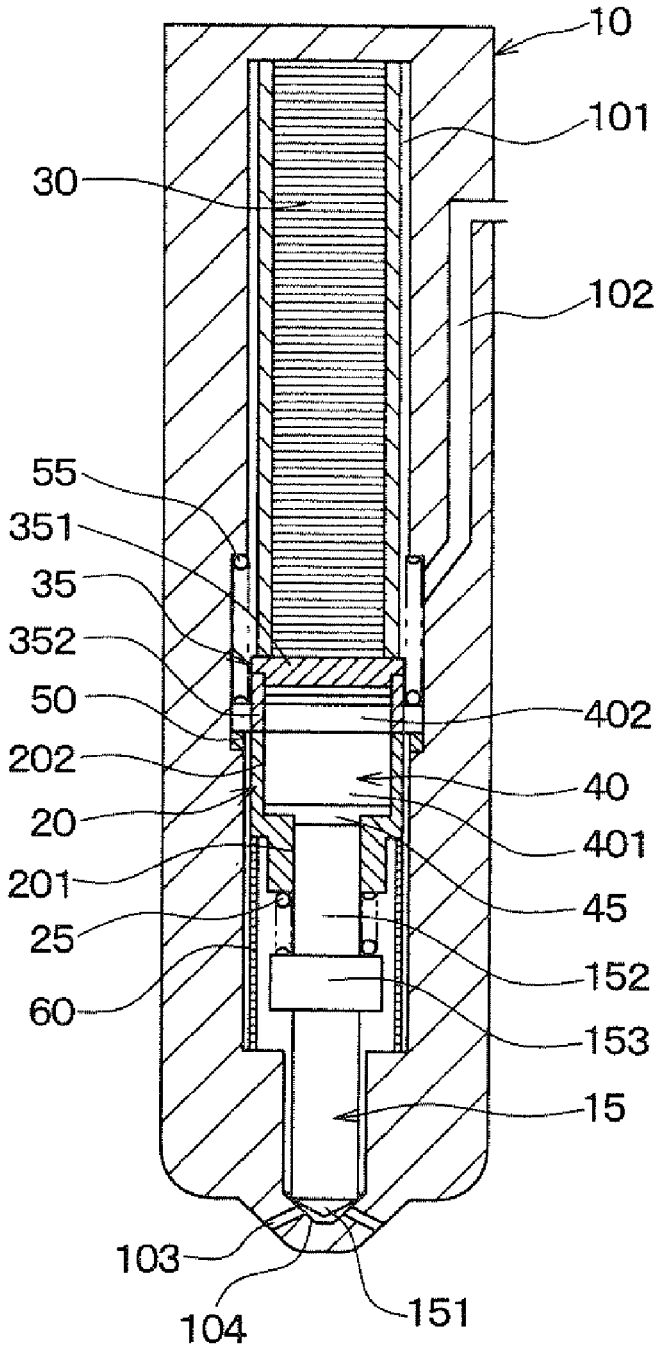
FIG. 8 is a longitudinal sectional view illustrating a configuration of a fuel injection valve according to a fourth embodiment of the invention.
Figure 9:
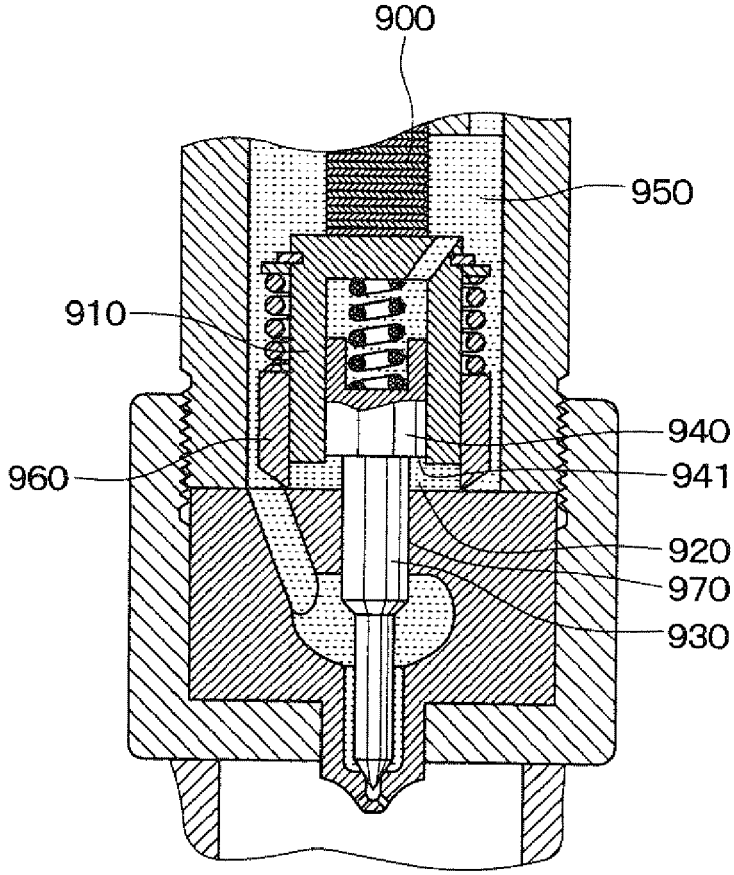
FIG. 9 PRIOR ART
FIG. 9 is a longitudinal sectional view illustrating a configuration of a previously proposed fuel injection valve.

As shown in FIG. 8, in a fuel injection valve of the fourth embodiment, the high pressure fuel passage 102 is connected to the receiving space 101 near one end side of a piezo stack 30 in a body axial direction. Accordingly, the pressure drop is lessened and reliability (internal-pressure strength) is improved. Furthermore, the fuel injection valve has a high degree of flexibility in designing components received by the receiving space 101 other than the piezo stack 30.

Additional advantages and modifications will readily occur to those skilled in the art. The invention in its broader terms is therefore not limited to the specific details, representative apparatus, and illustrative examples shown and described.

What is claimed is:

1. A fuel injection valve comprising:

a body having a high pressure fuel passage, through which high-pressure fuel flows, and a nozzle hole, which is connected to the high pressure fuel passage;

a nozzle needle disposed to open and close the nozzle hole and having a needle piston part;

a piezo stack configured to be extended when the piezo stack is charged with electric charge and configured to be contracted when the piezo stack discharges the electric charge;

a cylinder, in which the needle piston part of the nozzle needle is slidably inserted and which is driven by the piezo stack;

a fixed piston fixed to the body and having a fixed piston part, which is slidably inserted in the cylinder, wherein a diameter of the fixed piston part is larger than a diameter of the needle piston part;

an oil-tight chamber defined by the needle piston part and the fixed piston part and located between the needle piston part and the fixed piston part in the cylinder; and a nozzle spring disposed to urge the nozzle needle in a direction in which the nozzle needle closes the nozzle hole, wherein:

the cylinder is displaced as a result of the extension of the piezo stack, so that volume of the oil-tight chamber increases and thereby the nozzle needle opens the nozzle hole; and the cylinder is displaced as a result of the contraction of the piezo stack, so that the volume of the oil-tight chamber decreases and thereby the nozzle needle closes the nozzle hole.

2. The fuel injection valve according to claim 1, wherein the oil-tight chamber communicates with the high pressure fuel passage through a clearance between the cylinder and the needle piston part and a clearance between the cylinder and the fixed piston part.

3. The fuel injection valve according to claim 1, wherein the nozzle spring is held between the nozzle needle and the cylinder to urge the cylinder in a direction in which the volume of the oil-tight chamber decreases.

4. The fuel injection valve according to claim 1, further comprising a piezo spring configured to urge the cylinder in a direction in which the volume of the oil-tight chamber decreases.

5. The fuel injection valve according to claim 4, wherein the piezo spring is a slit spring, which is obtained as a result of forming a metal plate material having many holes into a cylindrical shape.

6. The fuel injection valve according to claim 1, wherein:

the cylinder has a step portion on an inner circumferential surface of the cylinder;

the cylinder includes a first cylinder hole, in which the needle piston part is inserted, on one side of the step portion in an axial direction of the cylinder, and a second cylinder hole, in which the fixed piston part is inserted, on the other side of the step portion in the axial direction; and a diameter of the second cylinder hole is larger than a diameter of the first cylinder hole.

* * * * *